US011472200B2

(12) United States Patent
Matoba et al.

(10) Patent No.: US 11,472,200 B2
(45) Date of Patent: Oct. 18, 2022

(54) LIQUID DISCHARGE APPARATUS

(71) Applicant: BROTHER KOGYO KABUSHIKI KAISHA, Nagoya (JP)

(72) Inventors: Kenji Matoba, Nagoya (JP); Atsushi Ito, Nagoya (JP); Haruhisa Takayama, Nagoya (JP); Kenichi Naruse, Gifu (JP); Masahiro Noda, Ogaki (JP); Hiroyuki Tsujihara, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 19 days.

(21) Appl. No.: 17/213,956

(22) Filed: Mar. 26, 2021

(65) Prior Publication Data

US 2021/0300074 A1 Sep. 30, 2021

(30) Foreign Application Priority Data

Mar. 27, 2020 (JP) ..... JP2020-058239

(51) Int. Cl.
*B41J 11/00* (2006.01)

(52) U.S. Cl.
CPC ..... *B41J 11/00212* (2021.01)

(58) Field of Classification Search
CPC ..... B41J 11/00212; B41J 11/00218; B41J 13/0027
See application file for complete search history.

(56) References Cited

FOREIGN PATENT DOCUMENTS

| | | | |
|---|---|---|---|
| GB | 2471376 | A | 12/2010 |
| JP | 2005-313445 | A | 11/2005 |
| JP | 2010-94882 | A | 4/2010 |
| JP | 2011-5726 | A | 1/2011 |
| JP | 2017-144641 | A | 8/2017 |

*Primary Examiner* — Bradley W Thies
(74) *Attorney, Agent, or Firm* — Scully, Scott, Murphy & Presser, PC

(57) ABSTRACT

A liquid discharge apparatus includes: a head, a radiation unit, a movement mechanism, and a controller. The controller is configured to: acquire a radiation distance for each of a plurality of areas defined on a surface of a recording medium; control the movement mechanism and the head to discharge the liquid to the surface of the recording medium; and control the radiation unit to radiate the light onto the plurality of the areas of the recording medium so that the longer the radiation distance for each of the plurality of areas, the stronger a light emission intensity of each of the plurality of light sources which faces each of the plurality of areas in the first direction.

17 Claims, 10 Drawing Sheets

LIQUID DISCHARGE APPARATUS

CROSS REFERENCE TO RELATED APPLICATION

The present application claims priority from Japanese Patent Application No. 2020-058239, filed on Mar. 27, 2020, the disclosure of which is incorporated herein by reference in its entirety.

BACKGROUND OF THE INVENTION

Field of the Invention

The present invention relates to a liquid discharge apparatus based on the use of a liquid which is curable by being irradiated with a ray of light.

Description of the Related Art

A liquid discharge apparatus is known, which records an image by using a photocurable ink which is curable by being irradiated with a ray of light. For example, Japanese Patent Application Laid-open No. 2005-313445 discloses an ink-jet recording apparatus (liquid discharge apparatus) comprising recording heads each of which is formed with nozzles for discharging an ultraviolet curable ink (hereinafter referred to as "UV ink") from the nozzles onto a recording medium, an ultraviolet radiation device which is provided with an ultraviolet light source for curing the ink by radiating an ultraviolet ray onto the recording medium on which the ink has been landed, and a carriage which is movable in the main scanning direction while carrying the plurality of recording heads and the ultraviolet radiation device. The UV ink can be cured by the ultraviolet radiation, and the ink can be fixed on the recording medium. Therefore, the image can be also recorded on a recording medium such as a resin or the like into which any water-based ink cannot permeate.

In the meantime, in recent years, there is such a need that it is demanded to perform the image recording by using a photocurable ink on a recording medium having a three-dimensional surface (having, for example, a cylindrical shape, a spherical shape, or a concave/convex shape). When the image recording is performed on the recording medium having the three-dimensional surface by using the apparatus of Japanese Patent Application Laid-open No. 2005-313445, as shown in FIG. 10, the distance between the light-outgoing surface 202 of the ultraviolet radiation device 201 and the surface of the recording medium 210 differs depending on the place or position of the recording medium 210.

On this account, if the ultraviolet ray is radiated from the ultraviolet radiation device 201 at an identical light emission intensity, the larger the distance between the light-outgoing surface 202 of the ultraviolet radiation device 201 and the surface of the recording medium 210 is, the smaller the radiation intensity (illuminance) is. For example, with reference to FIG. 10, if the ultraviolet ray is radiated from the ultraviolet radiation device 201, the radiation intensity obtained at a portion having a distance x is smaller than that of a portion of a distance y (x>y). In this case, in order to cure the UV ink, it is necessary to radiate the ultraviolet ray so that the totalized light amount radiated onto the UV ink (radiation intensity x radiation time, multiplying radiation intensity by radiation time) is not less than a certain value. Therefore, assuming that the radiation time is constant, in order to cure the UV ink at the portion having the large distance x, it is necessary to adjust the light emission intensity of the ultraviolet radiation device 201 so that the totalized light amount is not less than the certain value at the portion of the distance x. However, in this situation, an excessive amount of the ultraviolet ray is radiated onto the surface of the recording medium 210 at the portion of the distance y. Then, the surface temperature of the portion of the distance y of the recording medium 210 is raised by the thermal energy of the ultraviolet ray, and it is feared that the deformation of the recording medium 210 may be caused. On the other hand, if the light emission intensity of the ultraviolet radiation device 201 is adjusted so that the totalized light amount is not less than the certain value at the portion of the distance y, then the radiation intensity is insufficient at the portion of the distance x, and it is impossible to sufficiently cure the UV ink.

An object of the present disclosure is to provide a liquid discharge apparatus in which any insufficient curing of a photocurable ink is hardly caused while suppressing the damage on a recording medium when the image recording is performed by using the photocurable ink on the recording medium having a surface of a three-dimensional shape.

SUMMARY OF THE INVENTION

According to an aspect of the present disclosure, there is provided a liquid discharge apparatus for recording an image on at least one recording medium, the liquid discharge apparatus including:

a head which has a nozzle surface having a plurality of nozzles and which is configured to discharge a photocurable liquid from the plurality of nozzles;

a radiation unit which has a plurality of light sources and which is configured to radiate light from the light sources to cure the liquid;

a movement mechanism which is configured to move the at least one recording medium or both of the head and the radiation unit in a direction parallel to the nozzle surface; and a controller configured to:

acquire a radiation distance for each of a plurality of areas defined on a surface of the at least one recording medium, the radiation distance ranging from each of the plurality of areas to the radiation unit in a first direction orthogonal to the nozzle surface;

control the movement mechanism and the head to discharge the liquid to the surface of the at least one recording medium from the plurality of nozzles while moving the at least one recording medium or both of the head and the radiation unit; and control the radiation unit to radiate the light from the plurality of light sources onto the plurality of the areas of the at least one recording medium on which the liquid has been landed, so that the longer the radiation distance for each of the plurality of areas, the stronger a light emission intensity of each of the plurality of light sources which faces each of the plurality of areas in the first direction.

DESCRIPTION OF THE PREFERRED EMBODIMENTS

First Embodiment

Figure 1:
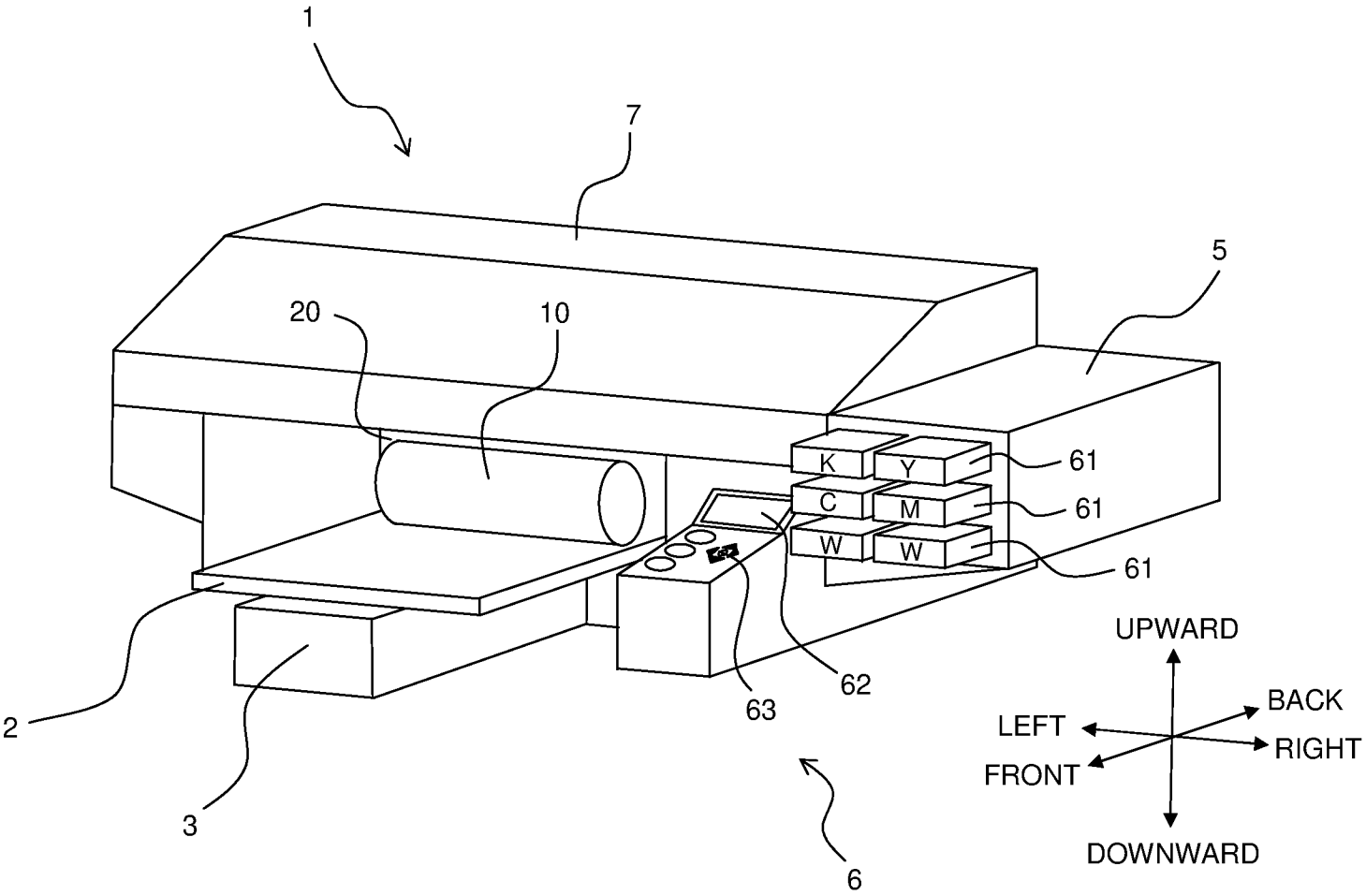
FIG. 1 shows a schematic perspective view illustrating an appearance of a printer according to a first embodiment of the present disclosure.

A printer 1 according to a first embodiment of the present disclosure will be explained below with reference to FIGS. 1 to 6. Note that the upward-downward direction, the front-back direction, and the left-right direction shown in FIG. 1 are defined as the upward-downward direction, the front-back direction, and the left-right direction of the printer 1. The upward-downward direction (orthogonal direction, first direction) is orthogonal to a nozzle surface 45 of an ink-jet head 42 described later on. The left-right direction (scanning direction, second direction) is orthogonal to the upward-downward direction and parallel to the nozzle surface 45. Further, the front-back direction (conveying direction, third direction) is orthogonal to the upward-downward direction and the left-right direction and parallel to the nozzle surface 45.

<Overall Configuration of Printer 1>

Figure 2:
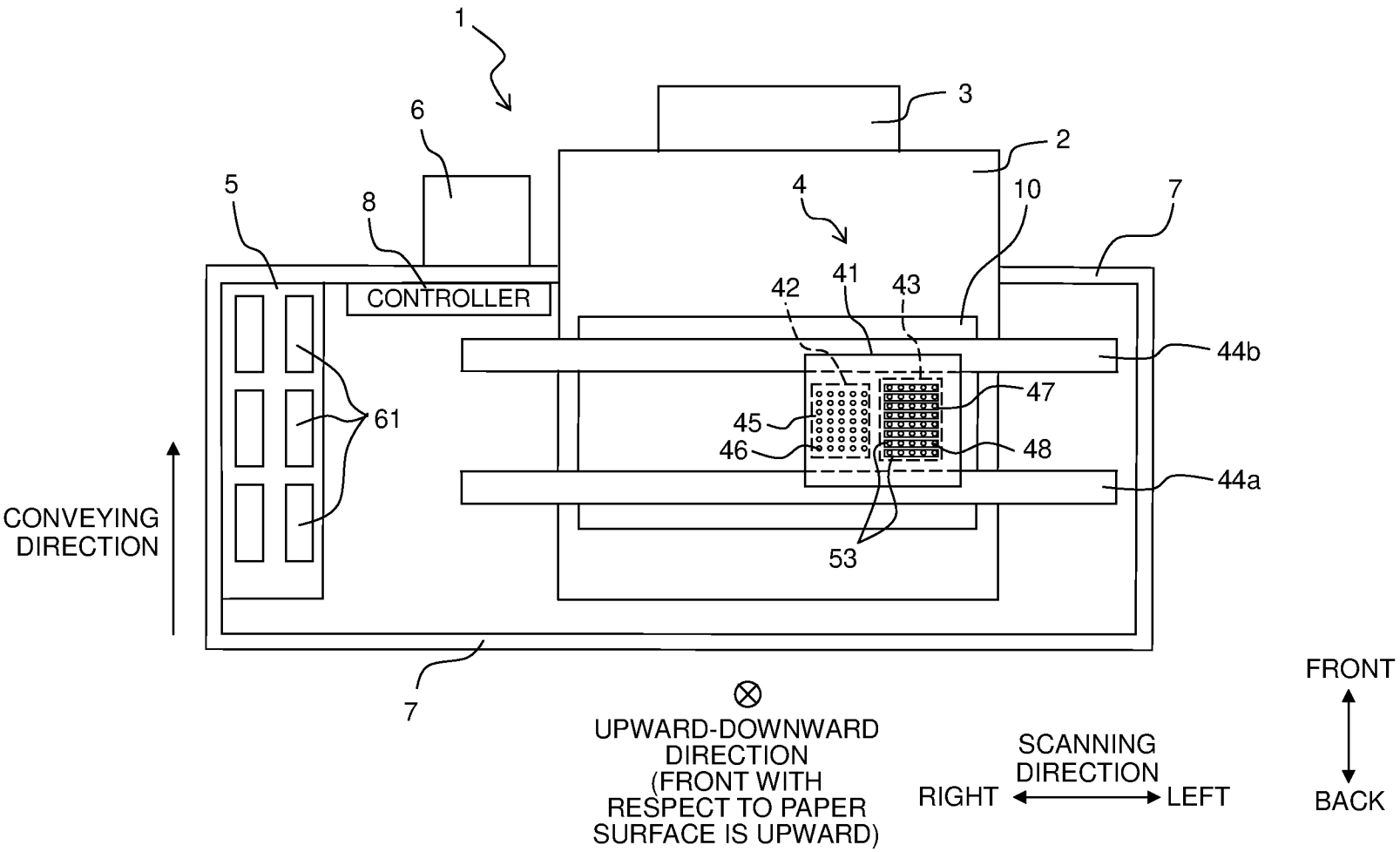
FIG. 2 shows a schematic top view illustrating an internal structure of the printer according to the first embodiment of the present disclosure.

As shown in FIGS. 1 and 2, the printer 1 (liquid discharge apparatus of the present disclosure) includes a platen 2, a conveying mechanism 3, a scanning mechanism 4 (movement mechanism of the present disclosure), an ink chamber 5, a control panel 6, a casing 7, and a control unit 8. An opening 20 is provided on a front surface of the casing 7.

The platen 2 is a flat plate-shaped member, and a recording medium 10 is placed on the upper surface. The platen 2 extends from the inside of the casing 7 through the opening 20 toward the front of the printer 1 in the vicinity of the center in the left-right direction of the printer 1. The conveying mechanism 3 is arranged under or below the platen 2. The driving force is applied from a conveying motor 31 (see FIG. 4). The platen 2 is allowed to slide in the conveying direction directed from the back to the front. Accordingly, the recording medium 10, which is placed on the upper surface of the platen 2, is conveyed in the conveying direction. Note that in the first embodiment, the recording medium 10 has a columnar shape. On this account, all of the cross-sectional shapes, which are orthogonal to the direction of the central axis of the column of the recording medium 10, have the same circular shape.

As shown in FIG. 2, the scanning mechanism 4 has a carriage 41 and two guide rails 44*a*, 44*b*. An ink-jet head 42 (head of the present disclosure) and a radiation head 43 (radiation unit of the present disclosure) are carried on the carriage 41. The carriage 41 is arranged over or above the platen 2 at the inside of the casing 7. The carriage 41 is supported by the two guide rails 44*a*, 44*b*. The two guide rails 44*a*, 44*b* are arranged while being separated from each other in the front-back direction, and the two guide rails 44*a*, 44*b* extend in the left-right direction respectively. The carriage 41 is arranged to stride over the two guide rails 44*a*, 44*b*. Then, the carriage 41 is driven to make the reciprocative movement in the left-right direction as the scanning direction along the two guide rails 44*a*, 44*b* by means of a carriage motor 32 (see FIG. 4). That is, the printer 1 of this embodiment is a serial printer.

The ink-jet head 42 is carried on the carriage 41 so that a nozzle surface (discharge surface) 45, which is the lower surface of the ink-jet head 42, is opposed to the platen 2. The ink-jet head 42 is reciprocatively movable in the scanning direction together with the carriage 41. A plurality of nozzles 46 (discharge ports) are formed on the nozzle surface 45 in order to discharge inks. As shown in FIG. 2, the plurality of nozzles 46 are aligned at equal intervals in the conveying direction (front-back direction) orthogonal to the scanning direction to constitute nozzle arrays (nozzle rows). The nozzle arrays (nozzle rows) are arranged in five arrays in the scanning direction. Further, the inks, which are supplied from ink cartridges 61 for storing the inks of five colors (black, cyan, magenta, yellow, and white) as described later on, are discharged from the respective arrays of the nozzles 46 disposed on the nozzle surface 45 of the ink-jet head 42. Thus, an image is recorded on the recording medium 10. Note that the five color inks, which are discharged from the nozzles 46, are ultraviolet curable inks (photocurable liquids) which are cured by being irradiated with the ultraviolet ray.

Figure 3:
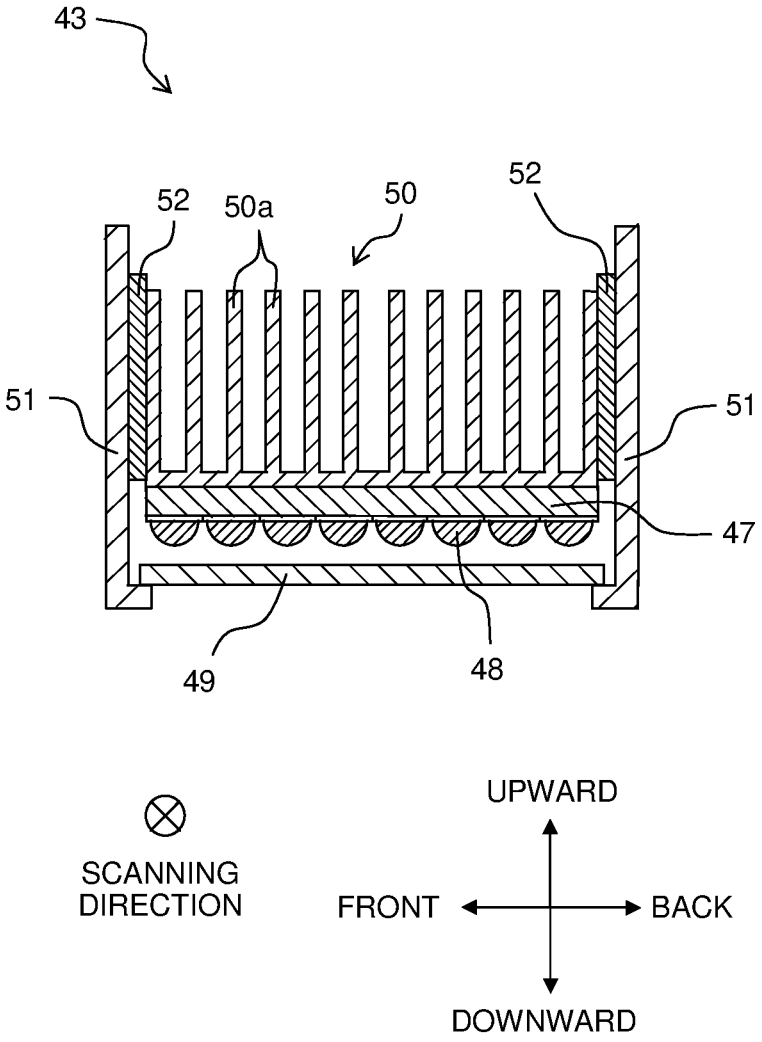
FIG. 3 shows a cross-sectional side view illustrating a structure of a radiation head.

The radiation head 43 is carried on the carriage 41 so that the radiation head 43 is positioned on the left side of the ink-jet head 42. The radiation head 43 is reciprocatively movable in the scanning direction together with the carriage 41 in the same manner as the ink-jet head 42. As shown in FIG. 3, the radiation head 43 has a substrate 47, lamp chips (light sources of the present disclosure) 48, a glass plate 49, a heat sink (heat release unit of the present disclosure) 50, a case unit 51, and a heat conduction member 52.

The substrate 47 is a flat plate-shaped member arranged at a lower portion of the radiation head 43, on which a circuit (not shown) is formed to supply the current to the lamp chips 48. The magnitude of the current flowing through the circuit is adjusted by the control unit (controller) 8 as described later on. Further, the lower surface of the substrate 47 is parallel to the upper surface of the platen 2.

The lamp chips 48 are provided in order to radiate the ultraviolet ray onto the recording medium 10 placed on the upper surface of the platen. As shown in FIG. 3, the plurality of lamp chips 48 are arranged on the lower surface of the substrate 47. The plurality of lamp chips 48 are connected to the circuit (not shown) arranged on the substrate 47. The light emission intensity L of the ultraviolet ray of the lamp chip 48 is determined by the magnitude of the current supplied from the circuit formed on the substrate 47. As shown in FIG. 2, the plurality of lamp chips 48 form lamp chip arrays (lamp chip rows, light source rows) 53, and in each of the lamp chip arrays (lamp chip rows, light source rows) 53, five lamp chips 48 are aligned at equal intervals in the scanning direction. Eight lamp chip arrays 53 are arranged in the conveying direction. The respective lamp chip arrays 53 are arranged at equal intervals. Further, as shown in FIG. 2, the lamp chips 48, which are included in the plurality of lamp chips 48 and which are arranged at the both ends in the conveying direction, are disposed at outer positions in the conveying direction as compared with the nozzles 46 which are included in the plurality of nozzles 46 and which are arranged at the both ends in the conveying direction. In the first embodiment, the lamp chips 48 are LED lamps. However, the lamp chips 48 are not limited to the LED lamps, which may be, for example, mercury lamps, cold cathode tubes, or metal halide lamps.

The glass plate 49 is the member which is provided in order to protect the lamp chips 48. As shown in FIG. 3, the glass plate 49 is arranged under or below the plurality of lamp chips 48. That is, the glass plate 49 forms the lower surface of the radiation head 43. Further, the glass plate 49 is formed of the member through which the ultraviolet ray is permeable.

The heat sink 50 is the member which is provided in order to release the heat generated when the lamp chips 48 radiate the ultraviolet ray. As shown in FIG. 3, the heat sink 50 is arranged on the upper surface of the substrate 47. The heat sink 50 is composed of a metal including, for example, aluminum, iron, and copper having satisfactory heat conduction characteristics. The heat sink 50 has a so-called fin structure in which a plurality of ribs 50*a* extending in the upward direction and the front-back direction are arranged in the scanning direction. Owing to the fin structure, it is possible to widen the heat conduction area of the heat sink 50, and the heat release efficiency is improved.

The case unit 51 is arranged at the both ends in the front-back direction of the radiation head 43. Further, the case unit 51 extends in the upward-downward direction from the position disposed over or above the heat sink 50 to the position disposed under or below the glass plate 49. The case unit 51 is bent inwardly in an L-shaped form in the vicinity of the lower end. The front and back ends of the glass plate 49 are placed and fixed to the horizontal inner portion of the case unit 51. That is, the case unit 51 covers the both sides in the front-back direction of the substrate 47, the plurality of lamp chips 48, the glass plate 49, and the heat sink 50. The case unit 51 is the sheet metal member which is formed of, for example, the metal member in the same manner as the heat sink 50. Note that the case unit 51 may be provided at the both ends in the scanning direction (left-right direction) of the radiation head 43, or the case unit 51 may be provided to surround the entire circumference of the radiation head 43.

The heat conduction member 52 is provided in order to conduct the heat from the heat sink 50 to the case unit 51. The heat conduction member 52 is arranged between the heat sink 50 and the case unit 51. The heat conduction member 52 is, for example, a sheet-shaped member having flexibility. An adhesive is applied to the surfaces disposed on the both sides of the heat conduction member 52. The heat sink 50 and the case unit 51 are adhered to one another with the heat conduction member 52 intervening therebetween.

The ink chamber 5 is the portion which is provided in order to accommodate six ink cartridges 61. As shown in FIGS. 1 and 2, the ink chamber 5 is provided on the right side in the left-right direction of the printer 1. Five color inks of black, cyan, magenta, yellow, and white are stored respectively in the six ink cartridges 61. Each of the black, cyan, magenta, and yellow inks is stored in one ink cartridge 61. The white ink is stored in two ink cartridges 61. Then, the six ink cartridges 61 are connected to the ink-jet head 42 to supply the inks to the nozzles 46 corresponding to the respective colors. Note that in FIG. 2, as for the six ink cartridges 61, the two arrays, which are arranged in the scanning direction, are aligned in three arrays in the conveying direction in order to view the drawing more comprehensively. However, actually, as shown in FIG. 1, as for the six ink cartridges 61, the two arrays, which are arranged in the scanning direction, are aligned in three arrays in the upward-downward direction. Then, the black cartridge is arranged on the left side, and the yellow cartridge is arranged on the right side in the upper array. The cyan cartridge is arranged on the left side, and the magenta cartridge is arranged on the right side in the middle array. The white cartridges are arranged on the both left and right sides in the lower array.

The control panel 6 is the portion which receives the printing setting and the shape data of the recording medium 10 inputted by a user. As shown in FIGS. 1 and 2, the control panel 6 is provided on the front surface of the printer 1 while being disposed on the right side. The control panel 6 has a monitor 62 which displays the printing setting and the operation situation of the printer 1 and buttons 63 which are provided for the user to input the predetermined printing setting and the shape data of the recording medium 10. Note that the control panel 6 may have a touch panel which makes it possible to input the printing setting and the shape data of the recording medium 10 by directly touching the display on the monitor.

Figure 4:
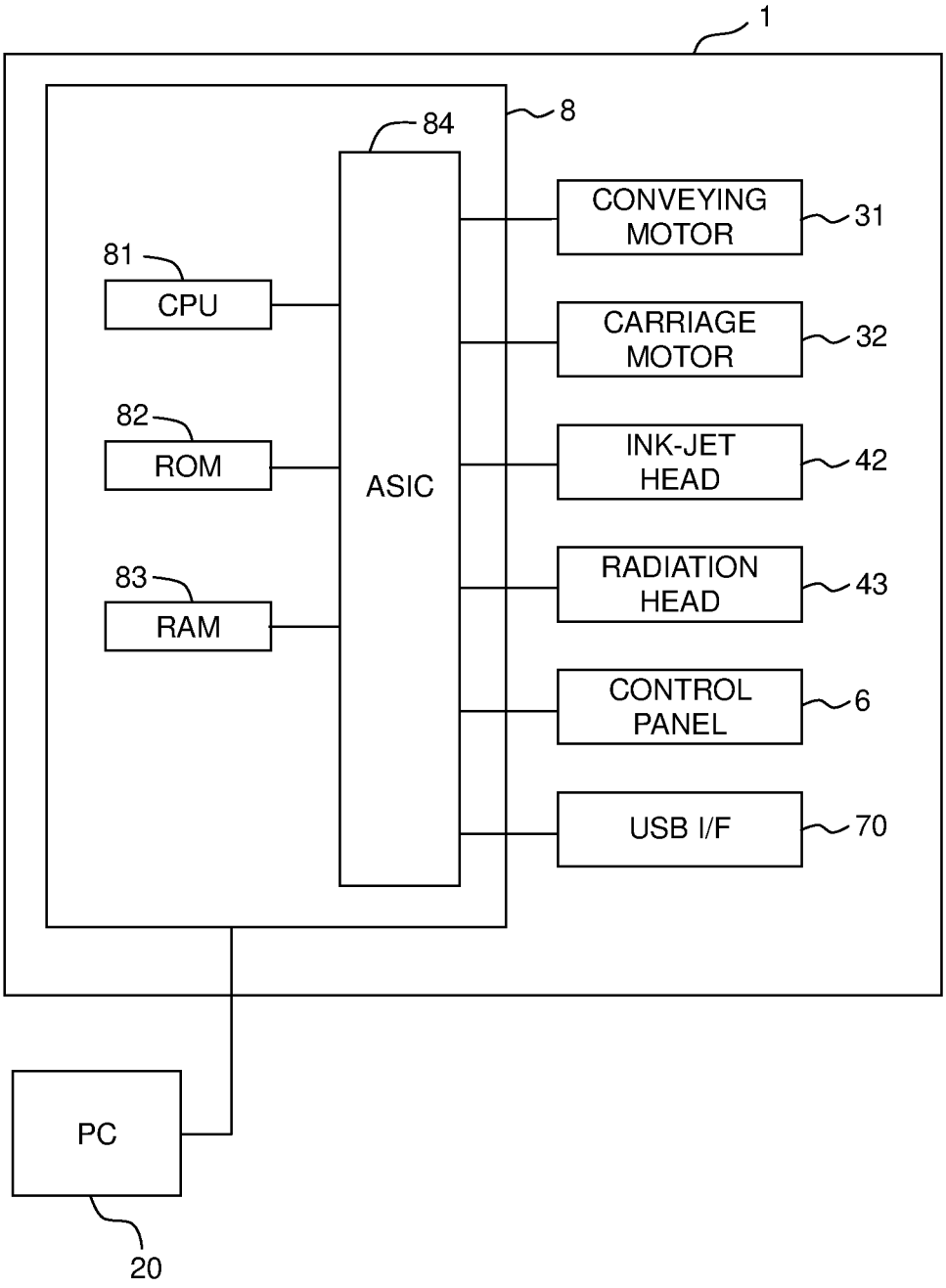
FIG. 4 shows a block diagram schematically illustrating electric configuration of the printer shown in FIG. 1 and PC connected thereto.

The control unit (controller) 8 controls the entire printer 1. As shown in FIG. 4, those electrically connected to the control unit 8 include, for example, the conveying motor 31, the carriage motor 32, the ink-jet head 42, the radiation head 43, and the control panel 6. Further, a USB interface 70 is electrically connected to the control unit 8. The USB interface 70 is the interface based on the USB standard, to which a USB memory can be connected as a removable memory. Additionally, PC (Personal Computer) 20 as an external apparatus is connected to the control unit 8. Note that the printer 1 and PC 20 may be connected via LAN (Local Area Network). Alternatively, the printer 1 and PC 20 may be connected, for example, by means of USB without using LAN intervening therebetween. Further, the data sending/receiving between the printer 1 and PC 20 may be performed by the communication based on a wireless system, or performed by the communication based on a wired system. Further, a portable terminal such as a smartphone or the like can be connected in a wireless manner to the printer 1 directly or by the aid of LAN.

The control unit 8 includes, for example, CPU (Central Processing Unit) 81, ROM (Read Only Memory) 82, RAM (Random Access Memory) 83, and ASIC (Application Specific Integrated Circuit) 84. ROM 82 stores, for example, various fixed data and programs to be executed by CPU 81 and ASIC 84. RAM 83 includes data (for example, image data) required when the program is executed.

Note that in the first embodiment, the control panel 6 and the USB interface 70 correspond to the data receiving unit of the present disclosure.

<Operation of printer 1>

Figure 6:
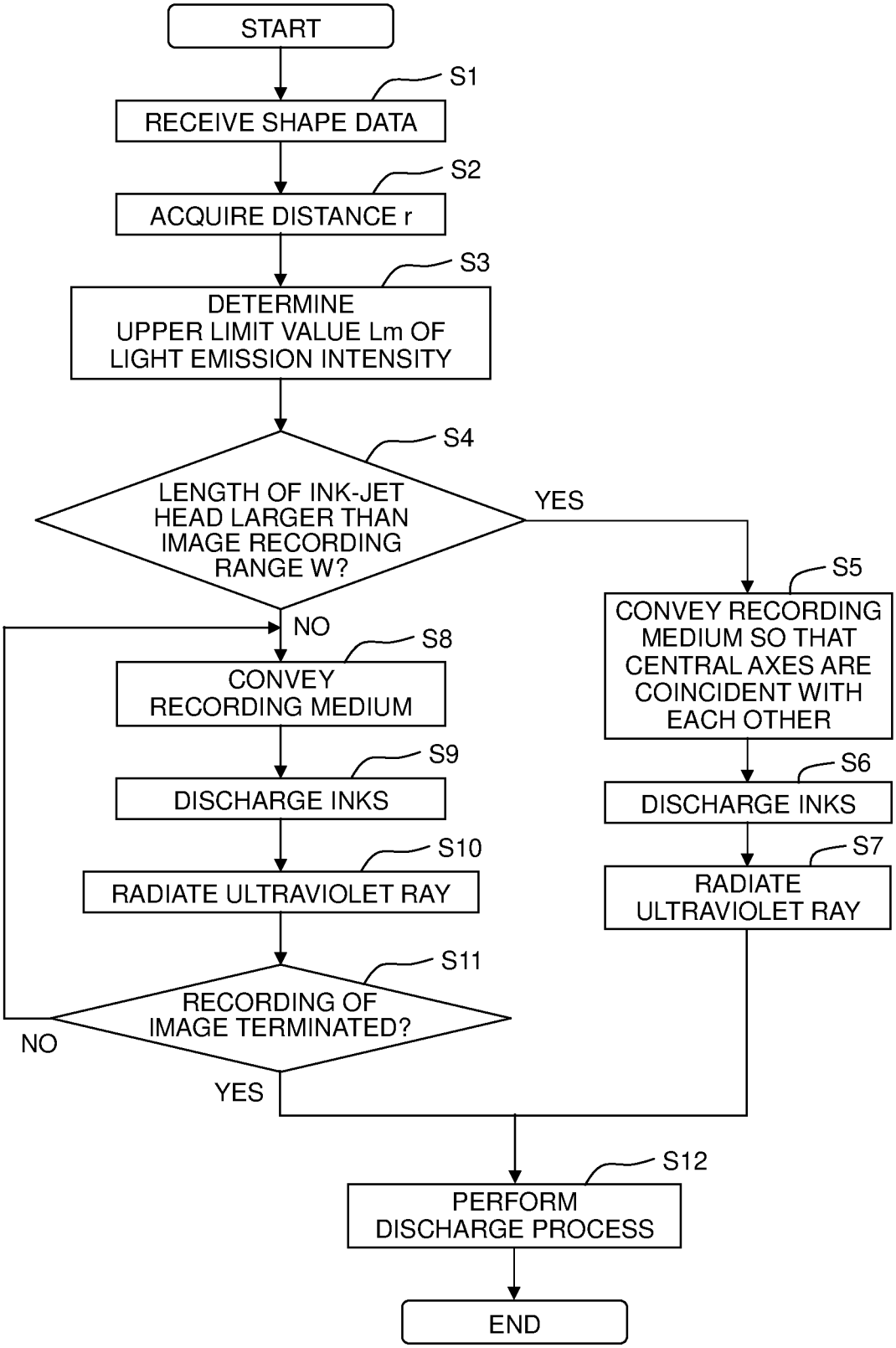
FIG. 6 shows a flow chart illustrating a recording operation of the printer according to the first embodiment.

Next, an explanation will be made with reference to a flow chart shown in FIG. 6 about the operation to be performed when the printer 1 according to the first embodiment records an image on the recording medium 10. In this embodiment, the recording medium 10, which has the columnar shape, is placed on the upper surface of the platen 2 so that the axial center direction of the column is coincident with the scanning direction. At first, the image data of the image to be recorded on the recording medium 10 is supplied to the printer 1 on the basis of the operation performed by the user for PC 20. The image data is temporarily stored in RAM 83.

Subsequently, the shape data of the recording medium 10 is inputted into the control panel 6 by the user. In another situation, the USB memory which stores the shape data of the recording medium 10 or the communication cable connected to an external device in which the shape data of the recording medium 10 is stored is connected to the USB interface 70. Accordingly, the control panel 6 or the USB interface 70 receives the shape data of the recording medium 10 (Step S1). In this embodiment, the shape data of the recording medium 10 includes the diameter and the length of the column. The received shape data of the recording medium 10 is temporarily stored in RAM 83. Note that the control unit 8, which is connected to PC 20, may directly receive the shape data of the recording medium 10 in accordance with the operation of PC 20. In this case, the control unit 8 also plays the role of the data receiving unit.

Figure 5:
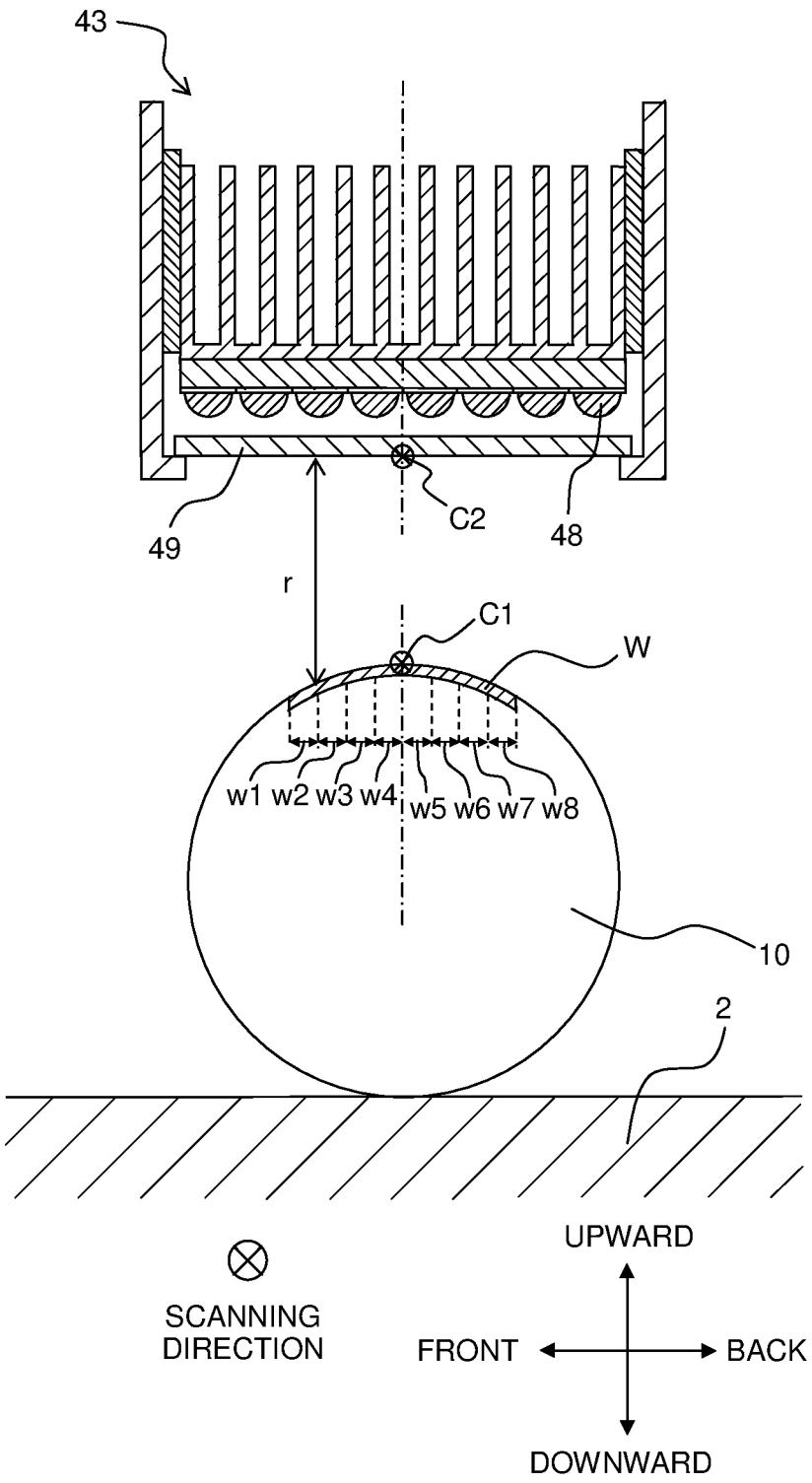
FIG. 5 shows a situation in which the radiation head and a recording medium are arranged opposingly.

Subsequently, the control unit 8 executes the distance acquiring process (Step S2) for acquiring the distances (radiation distances) r in the upward-downward direction from the plurality of areas w1 to w8 defined on the surface of the recording medium 10 to the lower surface (glass plate 49) of the radiation head 43 respectively, on the basis of the shape data of the recording medium 10 and the image data stored in RAM 83. The areas w1 to w8 extend in the scanning direction within an image recording range W on the surface of the recording medium 10. The control unit 8 calculates the distance r on the basis of the image data and the shape data of the recording medium 10. Note that in this embodiment, the "image recording range W" is the area disposed on the surface of the recording medium 10 on which the inks are landed in accordance with the liquid discharge process as described later on, and the image recording range is the hatched portion on the surface of the recording medium 10 as shown in FIG. 5. Further, in this embodiment, the "respective areas w1 to w8" are the respective areas which are obtained by evenly dividing the image recording range W into eight in the front-back direction. Note that the respective areas may be obtained by evenly dividing the recording range W into nine or more in the front-back direction, obtained by evenly dividing the recording range W into seven or less, or obtained by unevenly dividing the recording range W. Further, the distance r is the maximum distance between each of the areas w1 to w8 and the lower surface of the radiation head 43 in the upward-downward direction. For example, in the case of the area w1, the distance r is the distance in the upward-downward direction from the forefront portion in the front-back direction of the area w1 to the lower surface of the radiation head 43 (see FIG. 5).

Subsequently, the control unit 8 executes the upper limit value determining process (Step S3) for determining the upper limit value Lp of the light emission intensity L of the plurality of lamp chips 48 so that the maximum surface temperature Km of the estimated surface temperatures K of the respective areas w1 to w8 of the recording medium 10 is not more than a predetermined value Kp. Note that the estimated surface temperature K of the recording medium 10 is estimated on the basis of the distance r and the light emission intensities L of the plurality of lamp chips 48 for each of the areas w1 to w8 of the recording medium 10. For example, the estimated surface temperature K of the area w1 of the recording medium 10 is estimated on the basis of the distance r from the area w1 to the lower surface of the radiation head 43 and the light emission intensity L of the lamp chip 48 for radiating the ultraviolet ray onto the area w1. Further, the predetermined value Kp is the upper limit surface temperature of the recording medium 10 at which any damage to deform the recording medium 10 is not given to the recording medium 10 by the increase in the temperature.

In this context, the estimated surface temperature K of the recording medium 10 is estimated (calculated) in accordance with the following expression.

$$K=k\{(L\times A)/(r^2\times v)\} \quad \text{(Expression 1)}$$

A represents the light absorbance (absorption coefficient) of the recording medium 10, which is a constant as determined depending on, for example, the material of the recording medium 10. v represents the movement velocity in the scanning direction of the carriage 41 which carries the radiation head 43, and v is previously set by the user. k represents a transformation constant. Further, r represents each of the distances in the upward-downward direction from the respective areas w1 to w8 to the lower surface of the radiation head 43 as acquired in accordance with the distance acquiring process (S2) described above.

The control unit 8 determines the upper limit value Lp of the light emission intensities L of the plurality of lamp chips 48 in the upper limit value determining process so that the maximum surface temperature Km, which is the maximum of the respective estimated surface temperatures K of the respective areas w1 to w8 obtained on the basis of Expression 1, is not more than the predetermined value Kp.

Subsequently, the control unit 8 judges whether or not the length in the conveying direction of the ink-jet head 42 is larger than the length in the conveying direction of the image recording range W on the surface of the recording medium 10, on the basis of the image data stored in RAM 83 (Step S4).

If it is judged that the length in the conveying direction of the ink-jet head 42 is larger than the length in the conveying direction of the image recording range W (S4: YES), the control unit 8 executes the conveyance process (Step S5) to convey the recording medium 10 in the conveying direction by the conveying mechanism 3 so that the central axis C1 in the conveying direction of the image recording range W is opposed, in the upward-downward direction, to the central axis C2 in the conveying direction of the ink-jet head 42 as shown in FIG. 5 in the liquid discharge process to be subsequently executed (as described later on). Note that the "length in the conveying direction of the image recording range W" is the maximum length in the conveying direction of the image recording range (area on which the ink is to be landed). The "central axis C1" passes through the center of the length (maximum length) in the conveying direction of the image recording range W, and it extends in the scanning direction. Further, the "central axis C2" passes through the center, in the conveying direction, of the ink-jet head 42, and it extends in the scanning direction.

Subsequently, the control unit 8 executes the liquid discharge process (Step S6) for discharging the inks from the nozzles 46 of the ink-jet head 42 during the outward movement directed from the left side to the right side in the scanning direction of the carriage 41 effected by the scanning mechanism 4. In this procedure, the control unit 8 discharges the inks from only the nozzles 46 which land the inks onto the image recording range W of the recording medium 10.

The control unit 8 executes the ray radiation process (Step S7) for radiating the ultraviolet ray onto the image recording range W on which the inks have been landed, from the lamp chips 48 of the radiation head 43 immediately after the discharge of the inks from the nozzles 46 of the ink-jet head 42 during the outward movement directed from the left side to the right side in the scanning direction of the carriage 41 effected by the scanning mechanism 4. That is, both of the discharge of the inks from the nozzles 46 of the ink-jet head 42 and the radiation of the ultraviolet ray from the lamp chips 48 of the radiation head 43 are performed during one time of the outward movement of the carriage 41. As a result of the ultraviolet ray radiation, the inks, which have been landed on the image recording range W, are cured and fixed on the surface of the recording medium 10. Note that the control unit 8 adjusts, in the ray radiation process, the light emission intensity L of the lamp chip 48 for each of the lamp chip arrays 53, depending on the distance r in relation to each of the areas w1 to w8 as acquired by the distance acquiring process (S2). In particular, the control unit 8 adjusts the light emission intensity L of the lamp chip 48 for each of the lamp chip arrays 53 so that the lamp chip 48, which is disposed at the position opposed in the upward-downward direction to the area having the long distance r of the respective areas w1 to w8, has the strong or intensified light emission intensity L. In this procedure, the control unit 8 adjusts the light emission intensity of each of the lamp chips 48 so that the light emission intensity L of each of the lamp chips 48 is not more than the upper limit value Lp determined in the upper limit value determining process (S3) described above. Further, the control unit 8 stops the radiation of the ultraviolet ray from the lamp chip 48 disposed at the position not opposed in the upward-downward direction to the image recording range W of the recording medium in the ray radiation process.

If it is judged that the length in the conveying direction of the ink-jet head 42 is not more than the length in the conveying direction of the image recording range W (S4: NO), the control unit 8 executes the conveyance process (Step S8) to convey the recording medium 10 in the conveying direction by means of the conveying mechanism 3 so that at least the end portion of the portion of the image recording range W not recorded with the image, which is disposed on the downstream side in the conveying direction, is opposed in the upward-downward direction to the nozzle surface 45 of the ink-jet head 42.

Subsequently, the control unit 8 executes the liquid discharge process (Step S9) and the ray radiation process (Step S10) in the same manner as described above. After that, the control unit 8 judges whether or not the recording on the surface of the recording medium 10 is terminated for all of the images concerning the image data stored in RAM 83 (Step S11).

If it is judged that the recording on the surface of the recording medium 10 is not terminated for all of the images (S11: NO), the control unit 8 returns to Step S8 to execute the conveyance process again. Then, the control unit 8 repeatedly executes the conveyance process (S8), the liquid discharge process (S9), and the ray radiation process (S10) until the recording on the surface of the recording medium 10 is terminated for all of the images.

If it is judged that the recording on the surface of the recording medium 10 is terminated for all of the images (S11: YES), or after the ray radiation process of Step S7 is executed, the control unit 8 executes the discharge process (Step S12) for conveying the recording medium 10 to the position capable of being taken out from the opening 20, by means of the conveying mechanism 3. In accordance with the above, the operation, in which the printer 1 according to the first embodiment records the image on the recording medium 10, is terminated.

In the first embodiment, the distance r in the upward-downward direction is acquired (distance acquiring process), which ranges from each of the respective areas w1 to w8 on the surface of the recording medium 10 to the radiation head 43. Then, the inks are discharged from the nozzles 46 to the surface of the recording medium 10 while moving the carriage 41 in the scanning direction (liquid discharge process). The ultraviolet ray is radiated onto the respective areas w1 to w8 on which the inks have been landed (ray radiation process) so that the longer the distance r is, the stronger the light emission intensity L of the lamp chip 48 is, the lamp chip 48 being disposed at the position opposed in the upward-downward direction to the area of the respective areas w1 to w8 at which the distance r is given. According to this embodiment, it is possible to appropriately adjust the light emission intensities L of the plurality of lamp chips 48 for each of the areas, while considering the distance r from the area w1 to w8 on which the inks have been landed to the lamp chip 48. Therefore, any insufficient curing of the ultraviolet curable ink can be hardly caused, while suppressing the damage which would be otherwise caused by any excessive radiation of the ray of light onto the recording medium 10.

Further, in the first embodiment, the distance r is acquired in the distance acquiring process on the basis of the shape data of the recording medium 10 received by the data receiving unit such as the control panel 6 operated by the user or the USB interface 70 or the like connected with the USB memory or the communication cable. Therefore, it is unnecessary to provide any apparatus or device such as a sensor or the like to measure the distance. Further, in the first embodiment, the distance r is acquired for each of the areas w1 to w8 existing within the image recording range W on the basis of the image data stored in RAM 83. Therefore, it is enough to acquire the distance r for only the areas w1 to w8 on which the inks are landed. Therefore, it is easy to perform the calculating process.

Further, in the first embodiment, the radiation of the ultraviolet ray is stopped in the ray radiation process from the lamp chips 48 disposed at the positions not opposed in the upward-downward direction to the image recording range W of the recording medium 10. That is, the ultraviolet ray is radiated from only the lamp chips 48 disposed at the positions opposed in the upward-downward direction to the image recording range W of the recording medium 10. It is possible to realize the energy saving by stopping the ultraviolet ray radiation from a part of the plurality of lamp chips 48. Further, it is possible to avoid the increase in temperature of the non-recording range of the recording medium 10, which would be otherwise caused by the ultraviolet ray radiation. It is possible to further suppress the damage exerted on the recording medium 10.

Further, in the first embodiment, the recording medium 10 has the columnar shape in which all of the cross-sectional shapes orthogonal to the axial center direction of the column are the same circular shape. That is, as for the recording medium 10, the cross-sectional shapes, which are orthogonal to one direction (axial center direction of the column), are constant. Then, the recording medium 10 is placed on the upper surface of the platen 2 so that the axial center direction of the column is coincident with the scanning direction. In the ray radiation process, the light emission intensity L of the lamp chip 48 is adjusted for each of the lamp chip arrays 53. That is, the axial center direction of the column (one direction) of the recording medium 10 is allowed to coincide with the extending direction of the lamp chip array 53 (scanning direction). According to this embodiment, it is allowable not to change the light emission intensities L of the respective lamp chip arrays 53 when the carriage 41 is moved in the scanning direction in order to record the image with respect to the recording medium 10 having the columnar shape which is arranged while allowing the axial center direction of the column to coincide with the scanning direction (extending direction of the lamp chip array 53). Therefore, it is easy to perform the control.

Further, in the first embodiment, the conveying mechanism 3 is provided, which conveys the recording medium 10 in the conveying direction. The conveyance process for conveying the recording medium 10 in the conveying direction, the liquid discharge process described above, and the ray radiation process are repeatedly performed until the recording of the image is terminated on the recording medium 10. Therefore, it is possible to perform the image recording by using the ultraviolet curable inks with the serial printer 1 which performs the reciprocative movement of the carriage 41 in the scanning direction and the conveyance of the recording medium 10 in the conveying direction.

Further, in the first embodiment, when the length in the conveying direction of the ink-jet head 42 is larger than the length in the conveying direction of the image recording range W, the recording medium 10 is conveyed in the conveyance process so that the central axis C1 in the conveying direction of the image recording range W is opposed, in the upward-downward direction, to the central axis C2 in the conveying direction of the ink-jet head 42 in the liquid discharge process to be executed next to the conveyance process. Accordingly, it is possible to record the image by means of the movement of one time of the outward movement of the carriage 41 without conveying the recording medium 10 a plurality of times in the conveying direction.

Further, in the first embodiment, the lamp chips (a pair of end light sources) 48, which are included in the plurality of lamp chips 48 and which are arranged at the both ends in the conveying direction, are arranged on the outer sides in the conveying direction as compared with the nozzles (a pair of end nozzles) 46 which are included in the plurality of nozzles 46 and which are arranged at the both ends in the conveying direction. That is, the pair of end nozzles are positioned between the pair of end light sources in the conveying direction. Accordingly, when the carriage 41 is moved in the scanning direction, it is possible to reliably radiate the ultraviolet ray onto all of the inks discharged to the recording medium 10.

Further, the printer 1 of the first embodiment further comprises the heat sink 50 which is provided over or above the radiation head 43, the case unit 51, and the heat conduction member 52 which is provided between the heat sink 50 and the case unit 51. That is, the heat sink 50 is provided on the opposite surface (upper surface, second surface) in the vertical direction with respect to the surface (lower surface, first surface) of the radiation head 43 on which the plurality of lamp chips 48 are provided. According to this configuration, the heat is conducted from the heat sink 50 to the case unit 51 via the heat conduction member 52. Accordingly, it is possible to quickly release the heat generated by the ultraviolet ray radiation from the lamp chips 48. Accordingly, it is possible to maintain the constant temperature of the lamp chip 48, and it is possible to suppress the secular deterioration of the lamp chip 48.

Further, in the first embodiment, the upper limit value Lp of the light emission intensities L of the plurality of lamp chips 48 is determined (upper limit value determining process) so that the maximum surface temperature Km of the recording medium 10, which is estimated on the basis of the light emission intensity L and the distance r, is not more than the predetermined value Kp. Then, the adjustment is performed in the ray radiation process so that the light emission intensity L is not more than the upper limit value Lp. Accordingly, it is possible to avoid any exertion of the damage which would deform the recording medium 10, by providing the upper limit value for the light emission intensity L.

Second Embodiment

Next, a printer 1 according to a second embodiment will be explained with reference to FIGS. 7 and 8. In the following description, those configured in the same manner as in the first embodiment are designated by the same reference numerals, any explanation of which will be appropriately omitted.

In the first embodiment described above, if the length in the conveying direction of the ink-jet head 42 is larger than the length in the conveying direction of the image recording range W (S4: YES), the recording medium 10 is conveyed in the conveying direction (S5) so that the central axis C1 in the conveying direction of the image recording range W is opposed, in the upward-downward direction, to the central axis C2 in the conveying direction of the ink-jet head 42. In this context, an image is recorded on each of a plurality of recording media 10 having the same shape, and the length in the conveying direction of the image recording range W on the surface of each of the recording media 10 is smaller than the ink-jet head 42 in some cases. In this situation, if the conveyance process (S5) of the first embodiment described above is performed so that the central axis C1 is opposed to the central axis C2 in the upward-downward direction in relation to each of the recording media 10, the respective distances r between the respective areas in the image recording area W and the radiation head 43 are identical in relation to the plurality of recording media 10. In this procedure, in the ray radiation process, the control is performed so that the light emission intensity L is intensified for the lamp chip 48 disposed at the position opposed in the upward-downward direction to the area having the long distance r. Therefore, in the first embodiment described above, when the image is recorded on each of the plurality of recording media 10, the same lamp chips 48 having the strong light emission intensities L and the same lamp chips 48 having the weak light emission intensities L, which are included in the plurality of lamp chips 48, are always used. The degree of deterioration of the lamp chip 48 having the strong light emission intensity L is larger than that of the lamp chip 48 having the weak light emission intensity L. Therefore, the degrees of deterioration are scattered or dispersed among the respective lamp chips 48.

In view of the above, in the second embodiment, a conveyance process is executed, which makes it possible to obtain a uniform degree of deterioration of the plurality of lamp chips 48 when an image is recorded on a plurality of recording media 70*a*, 70*b*, 70*c* having the same shape in which the length in the conveying direction of the image recording range W is smaller than the length in the conveying direction of the ink-jet head 42. An explanation will be made below with reference to a flow chart shown in FIG. 8 about the operation to be performed when the printer 1 according to the second embodiment records the image on the three recording media 70*a*, 70*b*, 70*c* simultaneously placed on the upper surface of the platen 2.

Figure 7A:
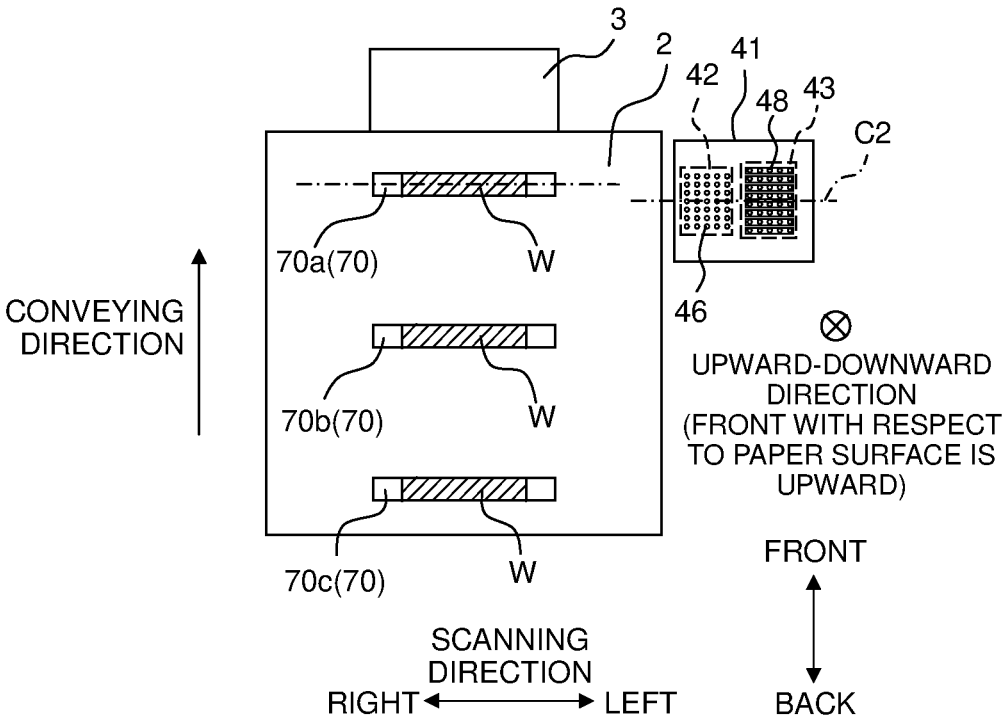
FIGS. 7A and 7B show positional relationships between the radiation head and the recording medium as provided before and after the execution of a conveyance process in relation to a printer according to a second embodiment.
Figure 7B:
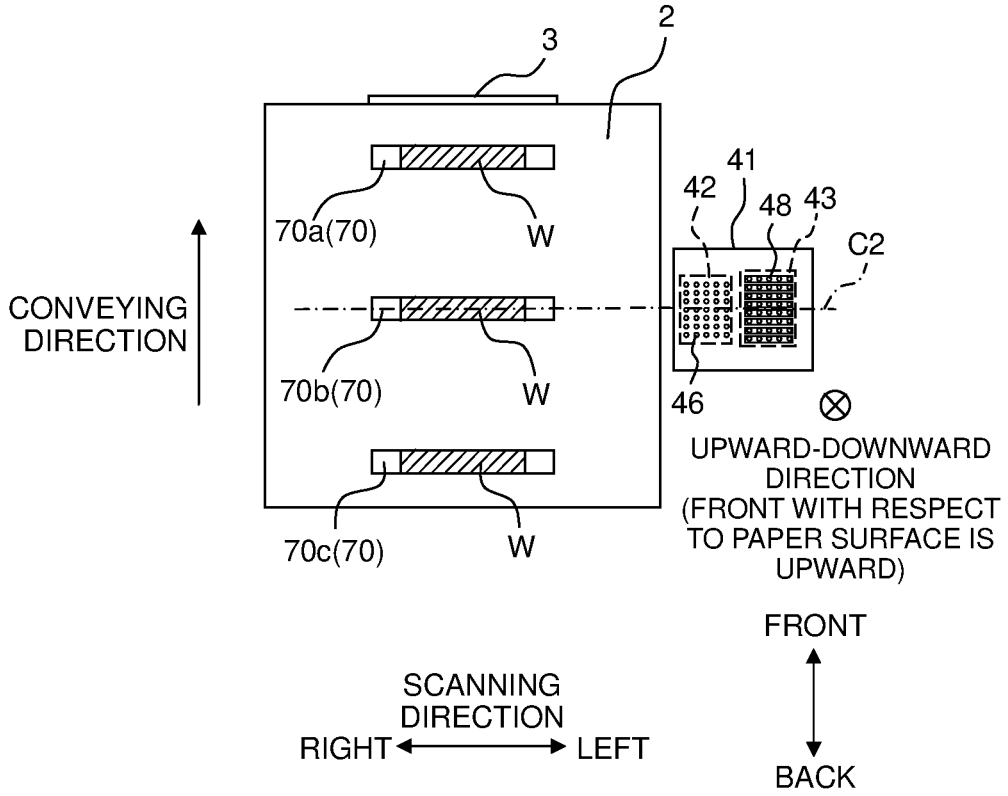
Figure 8:
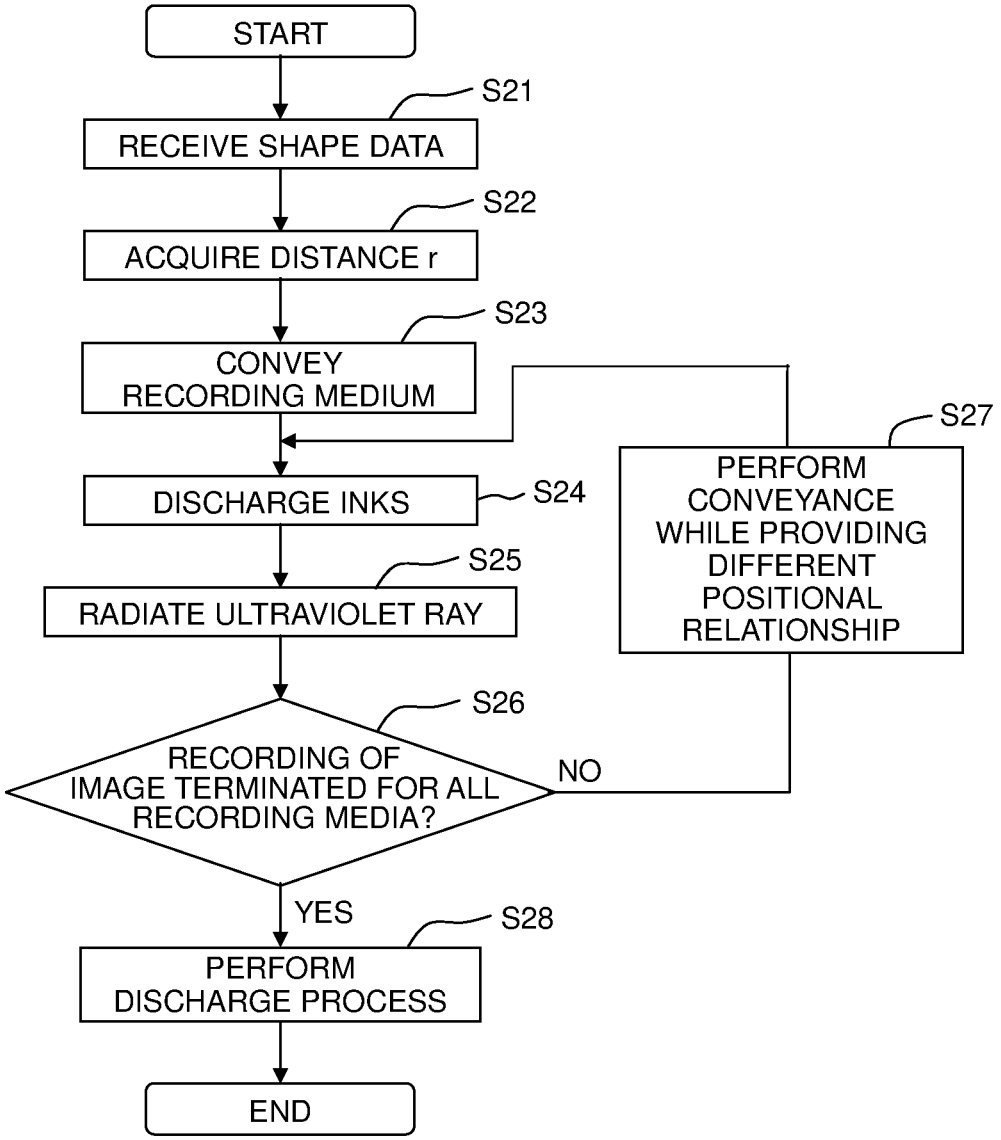
FIG. 8 shows a flow chart illustrating a recording operation of the printer according to the second embodiment.

In this embodiment, as shown in FIGS. 7A and 7B, the recording media 70*a*, 70*b*, 70*c*, which mutually have the same columnar shape, are placed on the upper surface of the platen 2, and the recording media 70*a*, 70*b*, 70*c* are arranged in the conveying direction so that the respective axial centers of the columns are coincident with the scanning direction. That is, the recording media 70*a*, 70*b*, 70*c* are arranged in the same orientation in the conveying direction. In this situation, the recording media 70*a*, 70*b*, 70*c* are arranged in this order from the front side in the front-back direction. The image recording ranges W of the respective recording media 70*a*, 70*b*, 70*c* are hatched portions shown in FIGS. 7A and 7B. Each of the recording media 70*a*, 70*b*, 70*c* has the recording range W having the same shape at the same place. Note that in order to view the drawings more comprehensively, the illustration of the guide rails 44*a*, 44*b* is omitted from FIGS. 7A and 7B.

At first, the image data of the image to be recorded on the recording medium 70 (70*a*, 70*b*, 70*c*) is supplied to the printer 1 on the basis of the operation of PC 20 performed by a user. The image data is temporarily stored in RAM 83. Subsequently, the control panel 6 or the USB interface 70 receives the shape data of the recording medium 70 (Step S21). The received shape data of the recording medium 70 is temporarily stored in RAM 83. After that, the control unit 8 executes the distance acquiring process (Step S22) in the same manner as the first embodiment described above.

Subsequently, as shown in FIG. 7A, the control unit 8 executes the conveyance process (Step S23) for conveying the recording medium 70*a* in the conveying direction so that the image recording range W of the recording medium 70*a* is included in the conveying direction by the ink-jet head 42, in the liquid discharge process to be executed next. That is, the control unit 8 conveys the recording medium 70*a* in the conveying direction so that the range, which is occupied in the conveying direction by the image recording range W, is included in the range which is occupied in the conveying direction by the ink-jet head 42.

After that, the control unit 8 executes the liquid discharge process (Step S24) for discharging the inks from the nozzles 46 of the ink-jet head 42 during the outward movement directed from the left side to the right side in the scanning direction of the carriage 41, in the same manner as in the first embodiment described above. Further, the control unit 8 executes the ray radiation process (Step S25) for radiating the ultraviolet ray from the lamp chips 48 of the radiation head 43 immediately after the discharge of the inks from the nozzles 46 during the outward movement directed from the left side to the right side in the scanning direction of the carriage 41, in the same manner as in the first embodiment described above. The image is recorded on the image recording range W of the recording medium 70*a* by means of the liquid discharge process (S24) and the ray radiation process (S25).

Subsequently, the control unit 8 judges whether or not the recording is terminated for the image relevant to the image data stored in RAM 83 in relation to all of the recording media 70*a*, 70*b*, 70*c* placed on the upper surface of the platen 2.

If it is judged that the recording of the image is not terminated for all of the recording media 70*a*, 70*b*, 70*c* (S26: NO), the control unit 8 executes the conveyance process (Step S27) for conveying the respective recording media 70*a*, 70*b*, 70*c* in the conveying direction so that the image recording range W of the recording medium 70*b* is included in the conveying direction by the ink-jet head 42.

In this procedure, the positional relationship in the conveying direction between the recording medium 70 and the radiation head 43 differs between the ray radiation process to be executed before the conveyance process of Step S27 and the ray radiation process to be executed after the conveyance process of Step S27. Specifically, when the ray radiation process is performed for the recording medium 70*a* (example of the first recording medium), as shown in FIG. 7A, the axial center of the column of the recording medium 70*a* is positioned on the front side in the front-back direction as compared with the central axis C2 of the radiation head 43 (in this embodiment, the central axis in the conveying direction of the radiation head 43 is identical to the central axis C2 of the rink-jet head 42). On the contrary, when the ray radiation process is performed for the recording medium 70*b* (example of the second recording medium) after performing the conveyance process of Step S27, as shown in FIG. 7B, the axial center of the column of the recording medium 70*a* is disposed at the position at which the axial center is approximately opposed to the central axis C2 of the radiation head 43 in the upward-downward direction. Then, after the conveyance process of Step S27, the control unit 8 returns to Step S24 to record the image on the image recording range W of the recording medium 70*b*. That is, in this embodiment, the control unit 8 conveys the recording medium 70*b* in the conveying direction in the conveyance process (Step S27) for conveying the recording medium 70*b* (example of the conveyance of the second medium) so that the positional relationship between the image recording range W of the recording medium 70*a* and the radiation head 43 during the radiation of the ray of light onto the recording medium 70*a* (example of the first recording medium) is different from the positional relationship between the image recording range W of the recording medium 70*b* and the radiation head 43 during the radiation of the ray of light onto the recording medium 70*b*.

Note that if the conveyance process is further executed thereafter, the positional relationships in the conveying direction between the respective recording media 70*a*, 70*b*, 70*c* and the radiation head 43 are allowed to mutually differ in the ray radiation process to be performed for the image recording range W of the recording medium 70*c*.

If it is judged that the image recording is terminated for all of the recording media 70*a*, 70*b*, 70*c* (S26: YES), the control unit 8 executes the discharge process (Step S28) for conveying all of the recording media 70*a*, 70*b*, 70*c* to the positions at which all of the recording media 70*a*, 70*b*, 70*c* can be taken out from the opening 20. According to the above, the operation is terminated to record the image on the three recording media 70*a*, 70*b*, 70*c* by the printer 1 according to the second embodiment.

The lamp chip 48, in which the light emission intensity L is intensified, has the large degree of deterioration as compared with the lamp chip 48 in which the light emission intensity L is weakened. If the degrees of deterioration of the lamp chips 48 are scattered or dispersed, it is difficult to perform the adjustment to the light emission intensity L required to cure the inks. In such a situation, it is impossible to sufficiently secure the quality of the recorded image. In the second embodiment, the distances between the respective areas of the image recording range W and the radiation head 43 differ for the recording media 70*a*, 70*b*, 70*c* respectively. Therefore, when the image is recorded on the three recording media 70*a*, 70*b*, 70*c* respectively, the lamp chips 48 having the strong light emission intensities L and the lamp chips 48 having the weak light emission intensities L, which are included in the plurality of lamp chips 48, are distinct from each other respectively. Accordingly, it is possible to obtain the uniform degree of deterioration of the lamp chips 48. Therefore, it is easy to adjust the light emission intensity L, and it is consequently possible to obtain a long service life of the radiation head 43.

Third Embodiment

Next, a printer 1 according to a third embodiment will be explained with reference to FIG. 9. In the following description, those configured in the same manner as in the first embodiment and the second embodiment are designated by the same reference numerals, any explanation of which will be appropriately omitted. Note that in this embodiment, a recording medium 80, which is placed on the upper surface of the platen 2, has a columnar shape. Further, FIG. 9 shows the positional relationship between a radiation head 143 and the recording medium 80 in the ray radiation process of the third embodiment.

Figure 9:
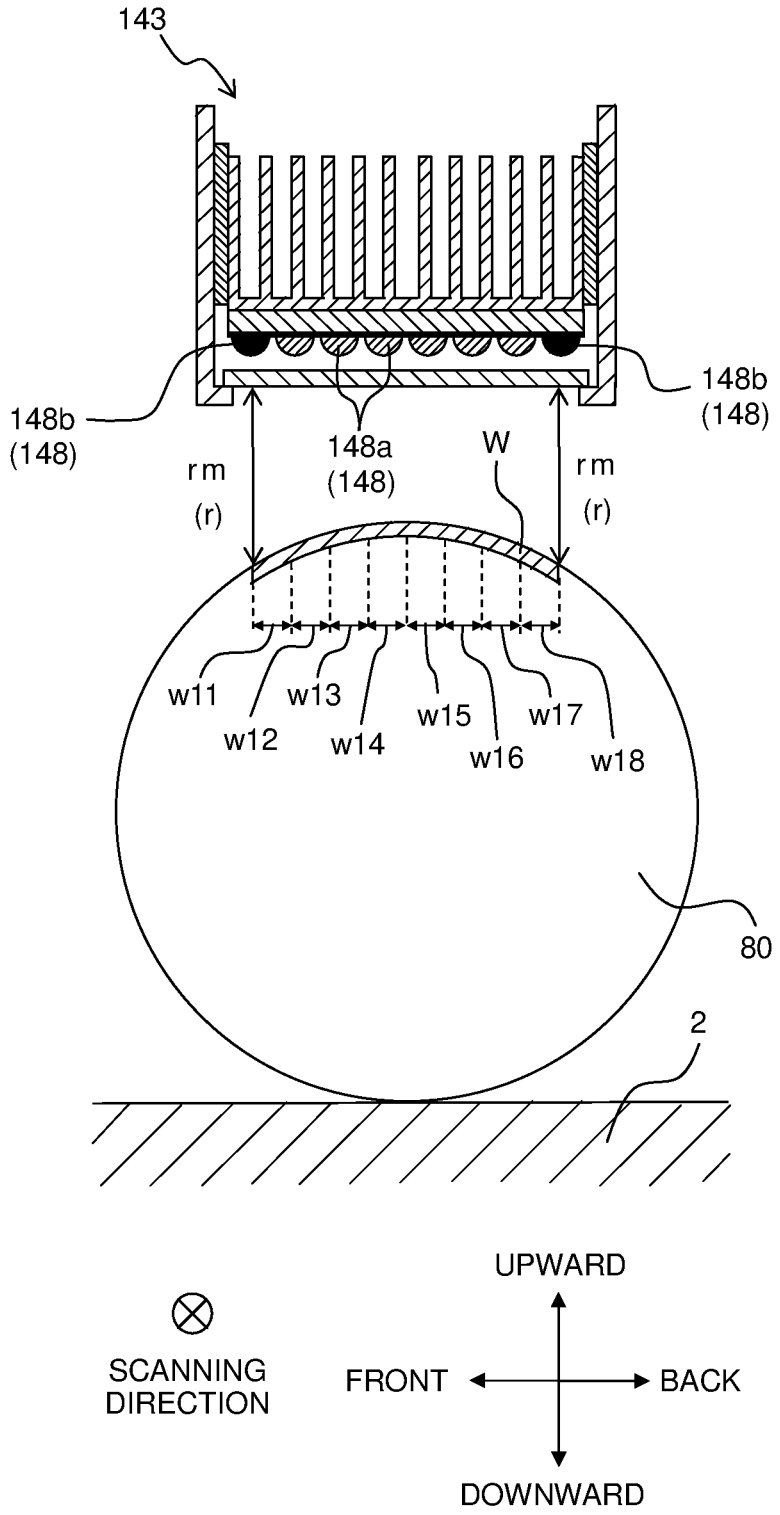
FIG. 9 shows a situation in which a radiation head and a recording medium are arranged opposingly according to a third embodiment.
Figure 10:
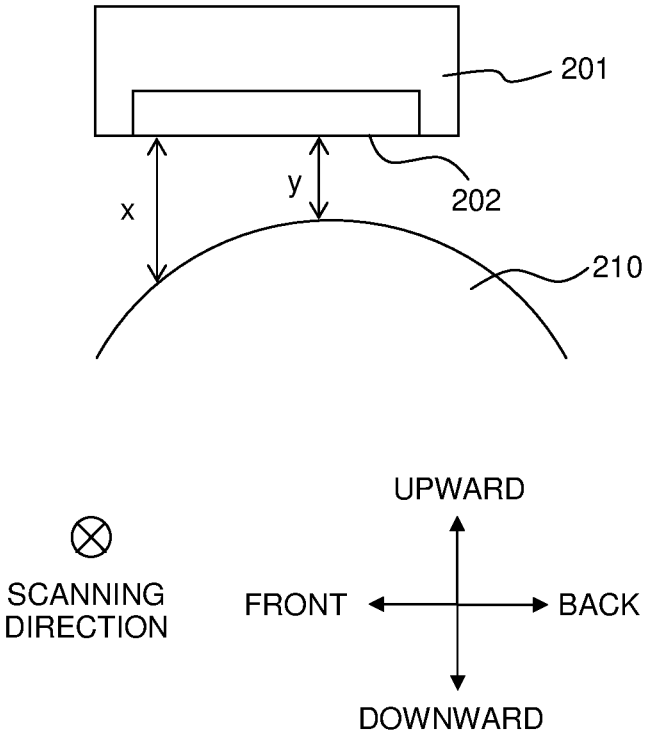
FIG. 10 shows a situation in which an ultraviolet radiation device and a recording medium are arranged opposingly in relation to a conventional printer.

In the third embodiment, as shown in FIG. 9, lamp chips 148 include ordinary lamp chips (first light sources) 148*a* and high intensity lamp chips (second light sources) 148*b* (black painted portions of the plurality of lamp chips 148). In the third embodiment, the high intensity lamp chips 148*b* are arranged at the front end and the back end in the front-back direction. The high intensity lamp chip 148*b* radiates the ultraviolet ray at the light emission intensity stronger than that of the ordinary lamp chip 148*a*, when the current, which has the same magnitude as that of the current supplied to the ordinary lamp chip 148*a*, is supplied.

In the third embodiment, the control unit 8 conveys the recording medium 80 in the conveying direction in the conveyance process so that the areas w11 and w18 are opposed to the high intensity lamp chips 148*b* in the upward-downward direction in the ray radiation process to be executed next to the conveyance process. Each of the areas w11 and w18 has the distance r (the maximum distance rm) that is the longest among that of the plurality of areas w11 to w18 disposed within the image recording range W of the recording media 80. After that, the control unit 8 executes the liquid discharge process and the ray radiation process in the same manner as in the first embodiment and the second embodiment described above.

According to the third embodiment, the areas (w11 and w18), in which the distance r is the maximum distance rm, are irradiated with the high intensity lamp chips 148*b*. Therefore, it is unnecessary to supply any excessive current from the circuit in order to increase the light emission intensity of the ultraviolet ray. Accordingly, the reduction in the electric power consumption is realized. Further, it is possible to more uniformize the overall electric power consumption amount of the lamp chips 148. Therefore, it is possible to suppress the scattering or dispersion of the secular deterioration of the respective lamp chips 148.

Modified Embodiments

Preferred embodiments of the present disclosure have been explained above. However, the present disclosure is not limited to the exemplary embodiments. It is possible to make various changes within the scope defined in claims.

In the embodiment described above, the control unit 8 acquires the distance r in the distance acquiring process on the basis of the image data stored in RAM 83 and the shape data of the recording medium 10. However, the printer 1 may be provided with a sensor for detecting the distance r between each of the areas w1 to w8 of the image recording range W and the radiation head 43. The control unit 8 may acquire the distance r in the distance acquiring process on the basis of a measured value of the sensor. In this case, the sensor and the control unit 8 are electrically connected to one another.

In the embodiment described above, the recording medium 10 has the columnar shape. However, the recording medium 10 may be any medium provided that the medium has a three-dimensional shape having a shape of the three-dimensional shape. For example, if the recording medium 10 has a region in which cross-sectional shapes orthogonal to one direction are identical with each other (region in which cross-sectional shapes orthogonal to one direction are constant), for example, such that the recording medium 10 partially has a columnar shape, then the recording medium 10 is preferably placed on the upper surface of the platen 2 so that one direction is coincident with the scanning direction. In this case, the control unit 8 adjusts the light emission intensities L of the plurality of lamp chips 48 for each of the lamp chip arrays 53 in the ray radiation process. Further, if the recording medium 10 does not have any region in which cross-sectional shapes orthogonal to one direction are identical with each other, then no problem arises even if the recording medium 10 is placed on the upper surface of the platen 2 in any direction. Note that if the recording medium 10 has any three-dimensional shape other than the columnar shape, the shape data of the recording medium 10 to be received may be as follows in Step S1 or Step S21 in the embodiment described above. That is, for example, in the case of a prism or polygonal pillar shape, the shape data may be the length of a diagonal line. In the case of any complicated three-dimensional shape, the shape data may be three-dimensional coordinate data to indicate relative positions of respective areas defined on the surface of the recording medium 10.

In the embodiment described above, the lamp chip arrays 53 are aligned in the conveying direction. However, the lamp chip arrays 53 may be aligned in the scanning direction. In this case, the control unit 8 acquires the distances r in the upward-downward direction to the lower surface of the radiation head 43 from the respective areas w1 to w8 obtained by partitioning or segmenting the image recording range W of the recording medium 10 in the left-right direction in the distance acquiring process. Then, the control unit 8 adjusts the light emission intensities L of the lamp chips 48 for each of the lamp chip arrays 53 in the ray radiation process so that the longer the distance r is, the stronger the light emission intensity L is for the lamp chip 48 disposed at the position opposed in the upward-downward direction to the area having the distance r of the respective areas w1 to w8 aligned in the left-right direction. Further, the control unit 8 may adjust the light emission intensities L of the lamp chips 48 for each of the lamp chips 48 in the ray radiation process.

In the embodiment described above, the control unit 8 executes the ray radiation process during the outward movement directed from the left side to the right side of the carriage 41. However, the control unit 8 may execute the ray radiation process during both of the outward movement directed from the left side to the right side of the carriage 41 and the homeward movement (return movement) directed from the right side to the left side. Accordingly, it is possible to more reliably cure the inks landed on the image recording range W on the surface of the recording medium 10. Further, the ultraviolet ray is radiated during the outward movement and during the homeward movement. Therefore, the ultraviolet ray is radiated onto the inks for a longer time as compared with when the ultraviolet ray is radiated during only the outward movement. On this account, it is possible to weaken the light emission intensity L required to cure the inks. It is possible to suppress the secular deterioration of the plurality of lamp chips 48.

In the embodiment described above, the radiation head 43 is arranged on the left side in the left-right direction of the ink-jet head 42. However, the radiation heads 43 may be arranged on the both sides in the scanning direction of the ink-jet head 42. In this case, the control unit 8 can execute the liquid discharge process and the ray radiation process during both of the outward movement and the homeward movement of the carriage 41 respectively.

In the first embodiment described above, the control unit 8 conveys the recording medium 10 in the conveying direction in the conveyance process of Step S5 so that the central axis C1 of the image recording range W and the central axis C2 of the ink-jet head 42 are opposed, in the upward-downward direction, each other in the liquid discharge process (S6) to be executed next. However, it is also allowable for the control unit 8 that the central axis C1 and the central axis C2 are not opposed each other in the upward-downward direction. In this case, the control unit 8 simply conveys the recording medium 10 in the conveying direction in the liquid discharge process (S6) to be executed next so that the ink-jet head 42 includes the image recording range W of the recording medium 10 in the conveying direction.

In the embodiment described above, the printer 1 is the serial printer including the carriage 41 on which the ink-jet head 42 and the radiation head 43 are carried and which is reciprocatively movable in the scanning direction. However, the printer 1 may be a line head printer comprising a fixed ink-jet head which has a length that is equal to or not less than the width in the scanning direction of the recording medium 10, and a radiation head which is fixed on the upstream side or the downstream side of the ink-jet head in the conveying direction. The inks are discharged from the fixed ink-jet head, while conveying the recording medium 10 in the conveying direction. Further, the ultraviolet ray is radiated from the radiation head, and thus the image is recorded. Note that in this case, the conveying mechanism for conveying the recording medium 10 corresponds to the movement mechanism of the present disclosure.

In the second embodiment described above, the image is recorded on the three recording media 70 having the same shape simultaneously placed on the upper surface of the platen 2. However, the image may be recorded on four or more recording media 70 having the same shape simultaneously placed on the upper surface of the platen 2 respectively. In this case, it is preferable that the positional relationships in the conveying direction between the respective recording media 70 and the radiation head 43 are different from each other in the ray radiation process performed for the image recording ranges W of the four or more recording media 70, in the conveyance process to be executed a plurality of times.

In the third embodiment described above, the high intensity lamp chips 148*b* are arranged at the front end and the back end in the front-back direction. However, the high intensity lamp chips 148*b* may be arranged at any positions.

In the first embodiment described above, the control unit 8 determines the upper limit value Lp of the light emission intensity L common to all of the lamp chips 48 in the upper limit value determining process so that the maximum surface temperature Km of the respective estimated surface temperatures K of the respective areas w1 to w8 of the recording medium 10 is not more than the predetermined value Kp. However, the control unit 8 may determine the upper limit value Lp of the light emission intensity L for each of the plurality of lamp chips 48 corresponding to each of the areas w1 to w8 so that the maximum surface temperature Km of each of the areas w1 to w8 of the recording medium 10 is not more than the predetermined value Kp. Accordingly, it is possible to hardly cause any insufficient curing of the ultraviolet curable inks while suppressing the damage which would be otherwise caused by any excessive ultraviolet ray radiation onto the recording medium 10.

In the embodiment described above, the printer has been explained, which uses the ultraviolet curable ink that is curable by being irradiated with the ultraviolet ray. However, the ink is not limited to the ultraviolet curable ink, which may be any photocurable ink. Further, there is no limitation to the ink. It is also allowable to use any photocurable liquid.

Note that all of the embodiments and the modified embodiments described above may be combined with each other unless they mutually exclude their combination partners.

What is claimed is:

1. A liquid discharge apparatus for recording an image on at least one recording medium, the liquid discharge apparatus comprising:

a head which has a nozzle surface having a plurality of nozzles and which is configured to discharge a photocurable liquid from the plurality of nozzles;

a radiation unit which has a plurality of light sources and which is configured to radiate light from the light sources to cure the liquid;

a movement mechanism which is configured to move the at least one recording medium or both of the head and the radiation unit in a direction parallel to the nozzle surface; and a controller configured to:

acquire a radiation distance for each of a plurality of areas defined on a surface of the at least one recording medium, the radiation distance ranging from each of the plurality of areas to the radiation unit in a first direction orthogonal to the nozzle surface;

control the movement mechanism and the head to discharge the liquid to the surface of the at least one recording medium from the plurality of nozzles while moving the at least one recording medium or both of the head and the radiation unit; and control the radiation unit to radiate the light from the plurality of light sources onto the plurality of the areas of the at least one recording medium on which the liquid has been landed, so that the longer the radiation distance for each of the plurality of areas, the stronger a light emission intensity of each of the plurality of light sources which faces each of the plurality of areas in the first direction.

2. The liquid discharge apparatus according to claim 1, wherein:

the movement mechanism is configured to move both of the head and the radiation unit in the direction parallel to the nozzle surface; and in a case of discharging the liquid, the controller is configured to control the movement mechanism and the head to discharge the liquid from the plurality of nozzles to the surface of the at least one recording medium while moving both of the head and the radiation unit.

3. The liquid discharge apparatus according to claim 2, wherein:

the movement mechanism includes a carriage on which the head and the radiation unit are carried, the movement mechanism being configured to reciprocatively move the carriage in a second direction orthogonal to the first direction;

the liquid discharge apparatus further comprises a conveying mechanism which configured to convey the at least one recording medium in a third direction orthogonal to the first direction and the second direction; and the controller is configured to:

in a case of discharging the liquid, control the movement mechanism and the head to discharge the liquid to the surface of the at least one recording medium while moving the carriage in the second direction; and in a case of radiating the light, control the movement mechanism and the radiation unit to radiate the light onto the surface of the at least one recording medium while moving the carriage in the second direction; and the controller further configured to control the conveying mechanism to convey the at least one recording medium in the third direction before the discharging of liquid.

4. The liquid discharge apparatus according to claim 3, wherein the controller is configured to control the movement mechanism, the head, the radiation unit, and the conveying mechanism to repeat the discharge of the liquid, the radiation of the light, and the conveyance of the at least one recording medium until the recording of the image is terminated on the at least one recording medium.

5. The liquid discharge apparatus according to claim 3, wherein:

the at least one recording medium has a region in which cross-sectional shapes orthogonal to one direction are constant;

a plurality of light source rows, in each of which the plurality of light sources are aligned in the second direction, are arranged in the third direction; and in a case of radiating the light, the controller is configured to control the radiation unit to adjust the light emission intensity of the light source for each of the light source rows under a condition that the at least one recording medium is arranged so that the one direction is the second direction.

6. The liquid discharge apparatus according to claim 3, wherein under a condition that a length in the third direction of the head is larger than a length in the third direction of a recording range of the image on the surface of the at least one recording medium, in a case of conveying the at least one recording medium, the controller is configured to control the conveying mechanism to convey the at least one recording medium so that a central axis in the third direction of the recording range of the image is opposed in the first direction to a central axis in the third direction of the head.

7. The liquid discharge apparatus according to claim 3, wherein under a condition that a length in the third direction of the head is larger than a length in the third direction of a recording range of the image on the surface of the at least one recording medium, in a case of conveying the at least one recording medium, the controller is configured to control the conveying mechanism to convey the at least one recording medium so that a range in the third direction occupied by the recording range of the image is included in a range in the third direction occupied by the head.

8. The liquid discharge apparatus according to claim 7, wherein the at least one recording medium includes a first recording medium and a second recording medium which have an identical shape, and under a condition that the first recording medium and the second recording medium are arranged in the third direction while being directed in an identical orientation, the controller is configured to:

control the movement mechanism, the head, the radiation unit, and the conveying mechanism to record the image on the first recording medium and the second recording medium in this order; and in a case of conveying the at least one recording medium, control the conveying mechanism to convey the second recording medium so that a first positional relationship and a second positional relationship are different each other, wherein the first positional relationship is a positional relationship in the third direction between the first recording medium and the radiation unit during radiation of the light onto the first recording medium, and the second positional relationship is a positional relationship in the third direction between the second recording medium and the radiation unit during radiation of the light onto the second recording medium.

9. The liquid discharge apparatus according to claim 3, wherein:

the plurality of light sources include a first light sources, and a second light source which radiates light at a light emission intensity stronger than that of the first light source under a condition that a current, which has the same magnitude as that of the first light source, is supplied; and in a case of conveying the at least one recording medium, the controller is configured to control the conveying mechanism to convey the at least one recording medium to a position at which the second light source faces in the first direction an area, of the at least one recording medium, having the longest radiation distance.

10. The liquid discharge apparatus according to claim 1, further comprising:

a data receiving unit configured to receive shape data of the at least one recording medium, wherein:

in a case of acquiring the radiation distance, the controller is configured to calculate the radiation distance on the basis of the shape data of the at least one recording medium received by the data receiving unit.

11. The liquid discharge apparatus according to claim 1, wherein in a case of acquiring the radiation distance, the controller is configured to acquire the radiation distance for each of areas within a recording range of the image on the surface of the at least one recording medium.

12. The liquid discharge apparatus according to claim 1, wherein in a case of radiating the light, the controller is configured to control the radiation unit to stop radiation of the light from a light source, among the plurality of light sources, not facing in the first direction a recording range of the image on the surface of the at least one recording medium.

13. The liquid discharge apparatus according to claim 1, wherein in a case of radiating the light, the controller is configured to control the radiation unit to radiate the light from only a light source, among the plurality of light sources, facing in the first direction a recording range of the image on the surface of the at least one recording medium.

14. The liquid discharge apparatus according to claim 1, wherein:

the plurality of nozzles include a pair of end nozzles which are arranged at both ends, in the third direction, of the plurality of nozzles;

the plurality of light sources include a pair of end light sources which are arranged at both ends, in the third direction, of the plurality of light sources; and the pair of end nozzles are positioned between the pair of end light sources in the third direction.

15. The liquid discharge apparatus according to claim 1, further comprising:

a heat release unit which is configured to release heat generated from the plurality of light sources provided on a first surface of the radiation unit, and which is located on a second surface of the radiation unit, the second surface being opposite in the first direction to the first surface of the radiation unit;

a case which covers the heat release unit and the radiation unit; and a heat conduction member which is provided between the heat release unit and the case and which conducts heat from the heat release unit to the case.

16. The liquid discharge apparatus according to claim 1, wherein:

the controller is further configured to determine an upper limit value of the light emission intensities of the plurality of light sources so that a maximum surface temperature of the at least one recording medium is not more than a predetermined value, the maximum surface temperature being calculated on the basis of the light emission intensity and the radiation distance; and in a case of radiating the light, the controller is configured to control the radiation unit so that the light emission intensities of the plurality of light sources are not more than the upper limit value.

17. The liquid discharge apparatus according to claim 1, wherein:

the movement mechanism is configured to move the at least one recording medium in the direction parallel to the nozzle surface; and in a case of discharging the liquid, the controller is configured to control the movement mechanism and the head to discharge the liquid from the plurality of nozzles to the surface of the at least one recording medium while moving the at least one recording medium.

* * * * *